US010522077B2

(12) United States Patent
Woo et al.

(10) Patent No.: US 10,522,077 B2
(45) Date of Patent: Dec. 31, 2019

(54) CURRENT INTEGRATOR AND ORGANIC LIGHT-EMITTING DISPLAY COMPRISING THE SAME

(71) Applicant: LG DISPLAY CO., LTD., Seoul (KR)

(72) Inventors: Kyoungdon Woo, Paju-si (KR); Chulwon Lee, Seoul (KR); Myunggi Lim, Ansan-si (KR); Juyoung Noh, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 464 days.

(21) Appl. No.: 15/365,200

(22) Filed: Nov. 30, 2016

(65) Prior Publication Data

US 2017/0154573 A1 Jun. 1, 2017

(30) Foreign Application Priority Data

Dec. 1, 2015 (KR) ..... 10-2015-0170200

(51) Int. Cl.
*G09G 3/3233* (2016.01)
*G09G 3/3266* (2016.01)
(Continued)

(52) U.S. Cl.
CPC ..... *G09G 3/3233* (2013.01); *G09G 3/3266* (2013.01); *G09G 3/3283* (2013.01); *G09G 3/3291* (2013.01); *G09G 2300/0819* (2013.01); *G09G 2310/027* (2013.01); *G09G 2310/0256* (2013.01); *G09G 2310/0291* (2013.01);
(Continued)

(58) Field of Classification Search
CPC combination set(s) only.
See application file for complete search history.

(56) References Cited

U.S. PATENT DOCUMENTS 4,641,105 A * 2/1987 Albaugh ..... H03F 3/45968 330/260
2014/0198092 A1 7/2014 Azizi et al.
(Continued)

FOREIGN PATENT DOCUMENTS

CN 104750301 A 7/2015
EP 2738757 A1 6/2014
(Continued)

*Primary Examiner* — Robin J Mishler
(74) *Attorney, Agent, or Firm* — Birch, Stewart, Kolasch & Birch, LLP

(57) ABSTRACT

An organic light-emitting display can include a display panel including sensing lines connected to pixels; a current integrator configured to receive current from a pixel through a sensing line connected to a first input terminal, receive a reference voltage through a reference voltage line connected to a second input terminal, and swap a path through which the current applied through the first input terminal flows and a path through which the reference voltage applied through the second input terminal is supplied; a sampling part including a first sample and hold circuit for sampling a first output voltage of the current integrator and a second sample and hold circuit for sampling a second output voltage of the current integrator, subsequent to the first output voltage, which outputs the first and second output voltages sampled by the first and second sample and hold circuits simultaneously through a single output channel.

8 Claims, 11 Drawing Sheets

(51) Int. Cl.
*G09G 3/3283* (2016.01)
*G09G 3/3291* (2016.01)

(52) U.S. Cl.
CPC . *G09G 2310/0294* (2013.01); *G09G 2310/08* (2013.01); *G09G 2320/0295* (2013.01); *G09G 2320/043* (2013.01); *G09G 2330/021* (2013.01)

(56) References Cited

U.S. PATENT DOCUMENTS

| | | | | |
|---|---|---|---|---|
| 2015/0185913 | A1 | 7/2015 | Han et al. | |
| 2015/0379909 | A1* | 12/2015 | Yu | G09G 3/006 345/690 |
| 2016/0076805 | A1 | 3/2016 | Woo et al. | |
| 2016/0155380 | A1* | 6/2016 | Kwon | G09G 3/3233 345/78 |

FOREIGN PATENT DOCUMENTS

| | | | |
|---|---|---|---|
| JP | 49-104541 | A | 10/1974 |
| JP | 59-208916 | A | 11/1984 |
| JP | 61-98481 | A | 5/1986 |
| JP | 1-202909 | A | 8/1989 |
| JP | 3-128531 | A | 5/1991 |
| JP | 6-195047 | A | 7/1994 |
| JP | 8-178972 | A | 7/1996 |
| JP | 2004-246097 | A | 9/2004 |
| JP | 2014-109775 | A | 6/2014 |
| KR | 10-1529005 | B1 | 6/2015 |
| KR | 10-1560492 | B1 | 10/2015 |
| TW | 200733036 | A | 9/2007 |

* cited by examiner (a)

(b)

CURRENT INTEGRATOR AND ORGANIC LIGHT-EMITTING DISPLAY COMPRISING THE SAME

This application claims the benefit of Korean Patent Application No. 10-2015-0170200, filed in the Republic of Korea on Dec. 1, 2015, the entire contents of which is incorporated herein by reference for all purposes as if fully set forth herein.

BACKGROUND OF THE INVENTION

Field of the Invention

The present invention relates to a current integrator and an organic light-emitting display comprising the same.

Discussion of the Related Art

An active-matrix organic light-emitting display includes self-luminous organic light emitting diodes (hereinafter, "OLEDs"), and has the advantages of fast response time, high luminous efficiency, high luminance, and wide viewing angle.

An OLED, which is a self-luminous element, includes an anode, a cathode and organic compound layers HIL, HTL, EML, ETL, and EIL formed between the anode and the cathode. The organic compound layers comprise a hole injection layer HIL, a hole transport layer HTL, an emission layer EML, an electron transport layer ETL, and an electron injection layer EIL. When an operating voltage is applied to the anode and the cathode, a hole passing through the hole transport layer HTL and an electron passing through the electron transport layer ETL move to the emission layer EML, forming an exciton. As a result, the emission layer EML generates visible light.

An organic light-emitting display has pixels arranged in a matrix, each pixel comprising an OLED, and adjusts the brightness of the pixels according to the grayscale of video data. Each pixel includes a driving element—i.e., driving TFT (thin film transistor)—that controls driving current flowing through the OLED in accordance with a voltage Vgs applied between its gate electrode and source electrode. The electrical characteristics of the driving TFTs, such as threshold voltage, mobility, etc., deteriorate with the passage of operation time and may vary from pixel to pixel. Such variations in the electrical characteristics of the driving TFTs cause differences in brightness between the pixels, thus making it difficult to realize a desired image.

As a way to compensate for variations in the electrical characteristics of the driving TFTs, internal compensation and external compensation are well known. In internal compensation, variations in threshold voltage between the driving TFTs are automatically compensated for within a pixel circuit. For internal compensation, the driving current flowing through the OLED should be determined regardless of the threshold voltage of the driving TFT, which makes the configuration of the pixel circuit quite complicated. Moreover, internal compensation is not suitable for compensating for variations in mobility between the driving TFTs.

In external compensation, sensed voltages and currents that match the electrical characteristics (threshold voltage and mobility) of the driving TFTs are measured, and an external circuit connected to a display panel modulates video data based on these sensed voltages, thereby compensating for variations in electrical characteristics. A lot of research is going on today regarding this external compensation approach.

In the conventional external compensation approach, a data driver circuit receives a sensed voltage directly from each pixel through a sensing line, converts this sensed voltage to a digital sensed value, and then feeds it to a timing controller. The timing controller compensates for variations in the electrical characteristics of the driving TFTs by modulating digital video data based on the digital sensed value.

The driving TFTs are current elements, so their electrical characteristics are accounted for by the amount of electrical current Ids flowing between the drain and source in response to a certain gate-source voltage Vgs.

The data driver circuit for the external compensation approach includes a sensing part that senses the electrical characteristics of the driving TFTs. The sensing part includes an integrator made up of an amplifier AMP, an integrating capacitor CFb, and a switch SW. In the integrator, the amplifier AMP includes an inverting input terminal (−) that receives the source-drain current Ids of the driving TFTs, a non-inverting input terminal (+) that receives a reference voltage Vref, and an output terminal that produces an integral, the integrating capacitor Cfb is connected between the non-inverting input terminal (−) and output terminal of the amplifier AMP, and the switch SW is connected to both ends of the integrating capacitor Cfb.

Each of a plurality of amplifiers AMP corresponding to a plurality of sensing lines has an offset voltage, and the offset voltage of the amplifier AMP is included in the integral produced from the output terminal of the amplifier AMP. Referring to FIG. 1, each amplifier AMP has a different offset voltage. In FIG. 1, the X-axis indicates the numbers of a plurality of sensing lines electrically connected respectively to a plurality of amplifiers AMP, and the V axis indicates the offset voltage which is output for each sensing line.

Since each amplifier AMP has a different offset voltage, the integral produced from their output terminal changes with the offset voltage even if substantially the same amount of current is input into the input terminal of each amplifier AMP. The integral has a large degree of dispersion due to the differences in offset voltage between the amplifiers AMP. Referring to FIG. 2, the large degree of dispersion of values of the integral makes it difficult to obtain accurate sensed values. In FIG. 2, the X-axis indicates the output voltage for each sensing line, which is sensed based on the integral, and the Y-axis indicates frequency.

There is a large dispersion among values of the sensed voltage around −50 and 50. When compensating for variations in the electrical characteristics of the pixels by using the sensed voltage values, there may be problems with the compensation characteristics regarding pixel compensation.

SUMMARY OF THE INVENTION

The present invention provides an organic light-emitting display including a display panel having sensing lines connected to pixels; a current integrator that receives current from the pixels through the sensing lines connected to a first input terminal and receives a reference voltage through a reference voltage line connected to a second input terminal and that swaps the path through which the current applied through the first input terminal flows and the path through which the reference voltage applied through the second input terminal is supplied; a sampling part that includes a first sample & hold circuit for sampling a first output voltage of the current integrator and a second sample & hold circuit for sampling a second output voltage of the current integrator, subsequent to the first output voltage, and that outputs the voltages sampled by the first and second sample & hold circuits simultaneously through a single output channel; and an analog-to-digital converter that converts the voltages received from the single output channel of the sampling part to digital sensed values and outputs the digital sensed values.

In another aspect, the present invention provides a current integrator including an amplifier having a first input terminal, a second input terminal, and an output terminal for outputting an output voltage; an integrating capacitor connected between the first input terminal and output terminal of the amplifier; and a reset switch connected to both ends of the integrating capacitor, in which the amplifier includes a swapping part that receives current from pixels through the first input terminal and receives a reference voltage through the second input terminal and that swaps the path through which the current applied through the first input terminal flows and the path through which the reference voltage applied through the second input terminal is supplied.

The present invention allows for obtaining sensed values that are more accurate by compensating for variations in offset voltage between current integrators, and enables panel compensation using the more accurate sensed values, thereby improving the reliability of sensing and compensation.

Moreover, the present invention can greatly reduce sensing time by implementing low-current and fast sensing of variations in the electrical characteristics of driving elements by a current sensing method using current integrators.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the invention, examples of which are illustrated in the accompanying drawings.

Hereinafter, an embodiment of the present invention will be described with reference to FIGS. 3 to 10.

Figure 1:
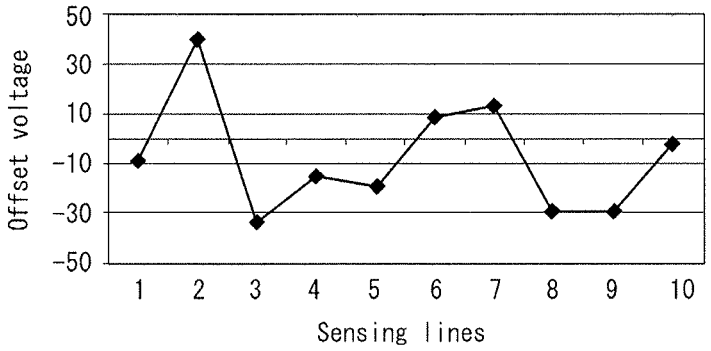
Fig. 1 (RELATED ART)
FIG. 1 is a view showing various offset voltages output from different current integrators according to the related art.
Figure 2:
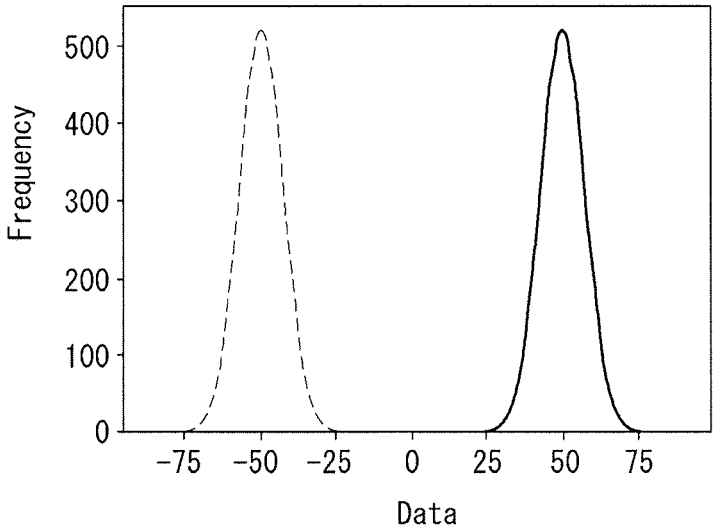
Fig. 2 (RELATED ART)
FIG. 2 is a view showing a large dispersion of output voltages respectively including the offset voltages output from the current integrators according to the related art.
Figure 3:
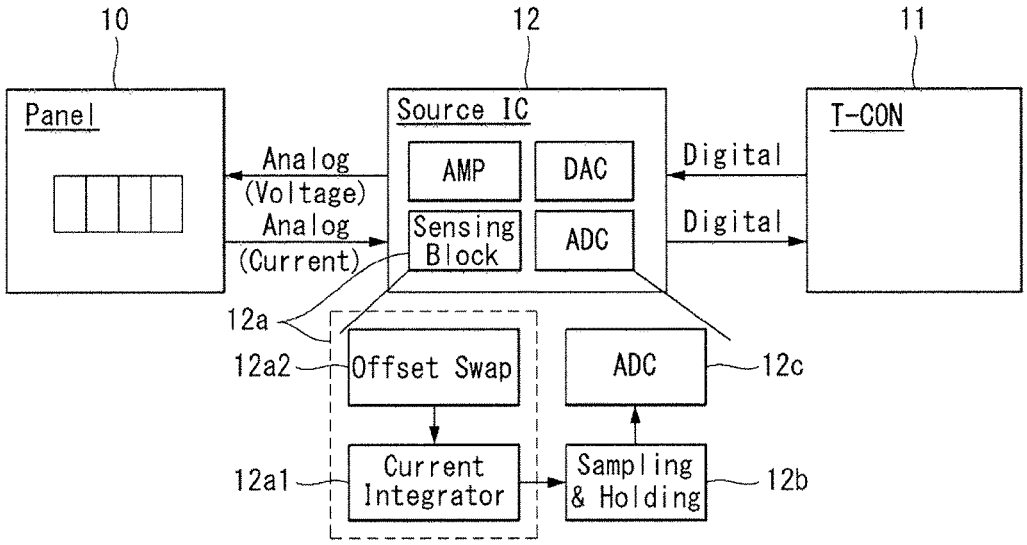
FIG. 3 is a block diagram showing main components for implementing current sensing according to an embodiment of the present invention.

FIG. 3 is a block diagram showing main components for implementing current sensing according to an embodiment of the present invention.

Referring to FIG. 3, a data driver IC (SDIC) 12 includes a sensing block (SB) 12*a*, a sampling part (SH) 12*a*, and an analog-to-digital converter (hereinafter, "ADC"), and current data is sensed by the pixels of a display panel 10.

The sensing block (SB) 12*a* includes a plurality of current integrators (CI) 12*a*1 and amplifiers AMP disposed within the current integrators (CI) 12*a*1, and integrates the current data input from the display panel 10. A swapping part 12*a*2 is disposed within each amplifier AMP, a first offset voltage is included in a first output voltage that is output from the sensing block (SB) 12*a* through the swapping part 12*a*2, and a second offset voltage is included in a second output voltage. A sampling part (SH) 12*b* samples the first and second output voltages including the first or second offset voltage, and delivers the sampled voltages simultaneously to the ADC 12C through a single output channel. The ADC 12C converts a voltage received from the single output channel of the sampling part (SH) 12*b* to a digital sensed value and then feeds it to a timing controller 11. The timing controller 11 derives compensation data for compensating for threshold voltage variations and mobility variations based on the digital sensed value, modulates image data for image display using this compensation data, and then feeds it to a data driver IC (SDIC) 12. The modulated image data is converted into a data voltage for image display by the data driver IC (SDIC) 12, and then the data voltage is applied to the display panel.

In the present invention, in order to compensate for variations in offset voltage between the current integrators (CI) 12*a*1 of the sensing block (SB) 12*a*, the swapping part 12*a*2 is embedded in each of the amplifiers AMP disposed within the data driver IC (SDIC) 12, and the swapping part 12*a*2 swaps the first output voltage including the first offset voltage and the second output voltage including the second offset voltage to alternately output the first or second output voltages.

The current integrator (CI) 12*a*1 swaps the path for current from a first input terminal and the path for a reference voltage from a second input terminal. The output terminal of the current integrator (CI) 12*a*1 outputs the first output voltage including the first offset voltage and the second output voltage including the second offset voltage.

The sampling part (SH) 12*b* sequentially stores the first output voltage and the second output voltage.

The present invention can greatly reduce sensing time by implementing low-current and fast sensing by a current sensing method using the current integrators (CI) 12*a*1. Moreover, the present invention can greatly improve the accuracy of compensation because variations in offset voltage between the current integrators (CI) 12*a*1 can be compensated for by the amplifiers AMP embedded in the sensing block and the sampling part 12*b* SH. Now, the technical idea of the present invention will be described concretely through embodiments.

Figure 4:
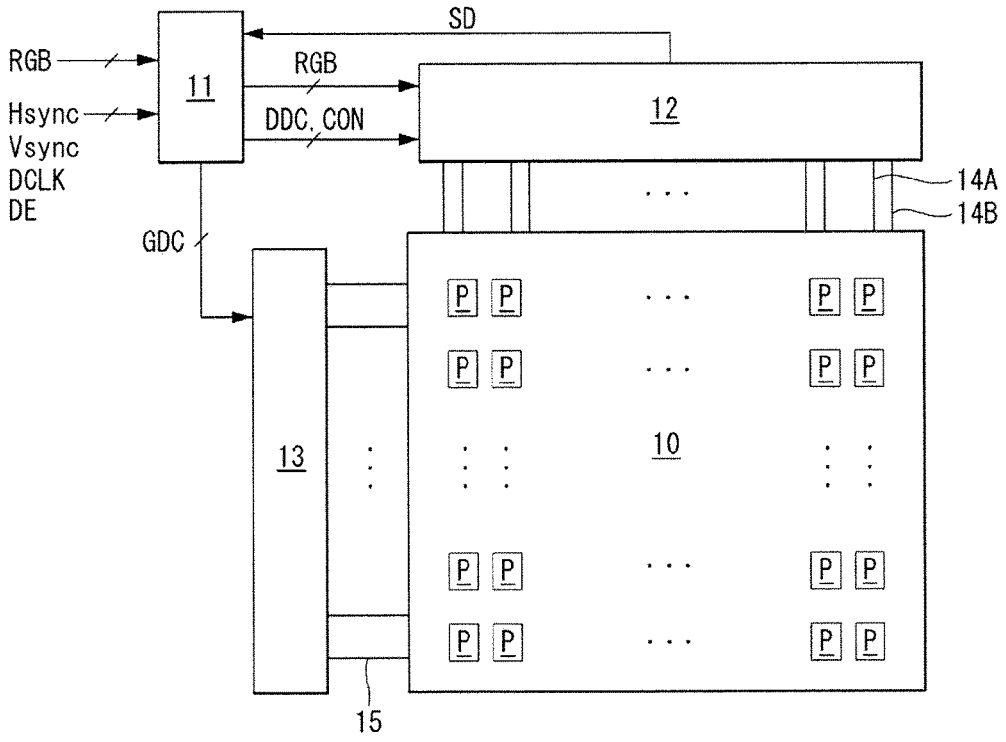
FIG. 4 shows an organic light-emitting display according to an embodiment of the present invention.
Figure 5:
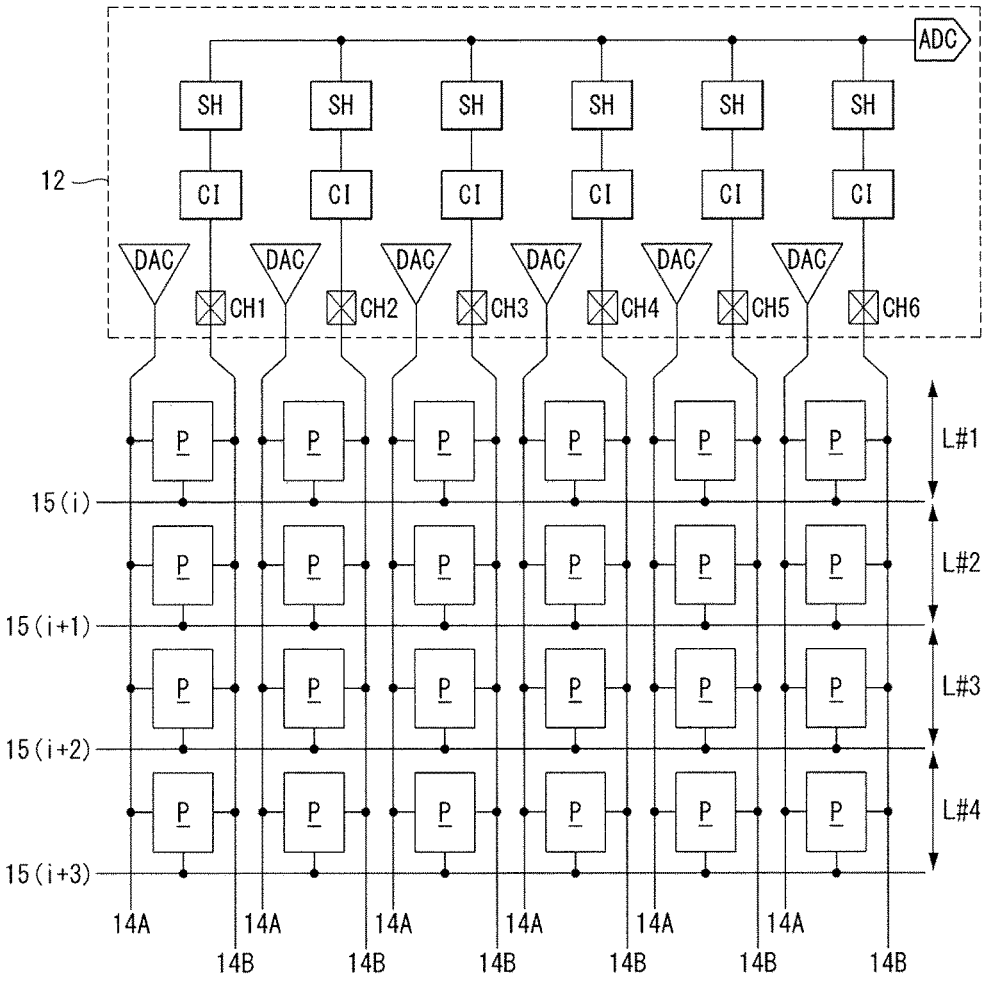
FIG. 5 shows a pixel array formed on the display panel of FIG. 4 and the configuration of a data driver IC for implementing a current sensing method according to an embodiment of the present invention.
Figure 6:
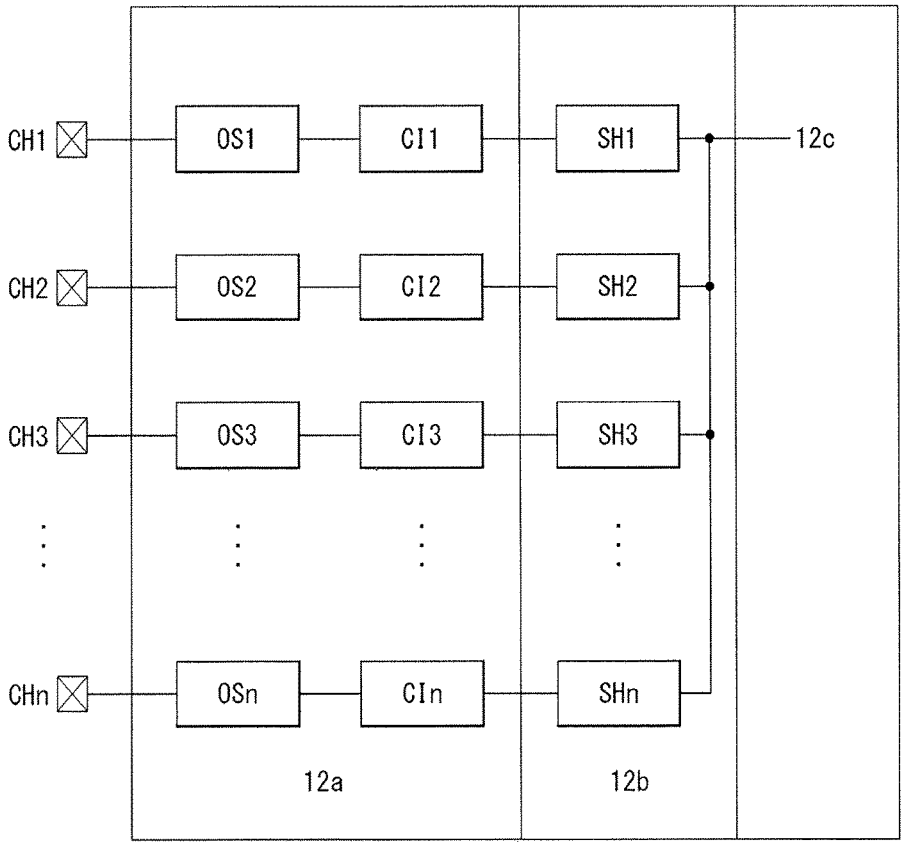
FIG. 6 shows amplifiers AMP embedded in a sensing block and a sampling part, in a data driver IC for implementing a current sensing method according to an embodiment of the present invention.

FIG. 4 shows an organic light-emitting display according to an embodiment of the present invention. FIG. 5 shows a pixel array formed on the display panel of FIG. 4 and the configuration of a data driver IC for implementing a current sensing method. FIG. 6 shows amplifiers AMP embedded in a sensing block (SB) 12*a* and a sampling part 12*b*, in a data driver IC for implementing a current sensing method.

Referring to FIGS. 4 to 6, the organic light-emitting display according to an embodiment of the present invention includes a display panel 10, a timing controller 11, a data driver circuit 12, and a gate driver circuit 13.

A plurality of data lines 14A and sensing lines 14B and a plurality of gate lines 15 intersect each other on the display panel 10, and pixels P are arranged in a matrix at every intersection.

Each pixel P is connected to one of the data lines 14A, one of the sensing lines 14B, and one of the gate lines 15. In response to a gate pulse input through a gate line 15, each pixel P is electrically connected to a data voltage supply line 14A and receives a data voltage from the data voltage supply line 14A, and outputs a sensing signal through a sensing line 14B.

Each pixel P receives a high-level driving voltage EVDD and a low-level driving voltage EVSS from a power generator. For external compensation, each pixel P of this invention can include an OLED, a driving TFT, first and second switching TFTs, and a storage capacitor. The TFTs of each pixel P may be implemented as p-type or n-type. A semiconductor layer of the TFTs of each pixel P may comprise amorphous silicon, polysilicon, or an oxide.

Each pixel P may operate differently in normal operation for displaying an image and in sensing operation for obtaining sensed values. The sensing operation may be performed for a predetermined length of time before the normal operation or in vertical blanking intervals during the normal operation.

The normal operation may be achieved by the driving operations of the data driver circuit 12 and gate driver circuit 13 under control of the timing controller 11. The sensing operation may be achieved by the sensing operations of the data driver circuit 12 and gate driver circuit 13 under control of the timing controller 11. An operation of deriving compensation data for variation compensation based on sensing results and an operation of modulating digital video data using compensation data are performed by the timing controller 11.

The data driver circuit 12 includes at least one data driver IC (integrated circuit) SDIC. The data driver IC (SDIC) includes a plurality of digital-to-analog converters (hereinafter, "DAC") connected to the respective data lines 14A, a sensing block (SB) 12*a* connected to the sensing lines 14B through sensing channels CH1 to CHn, a sampling part (SH) 12*b* that includes a plurality of sample & hold circuits for sampling the output voltages of the current integrators and that outputs the voltages sampled by the sample & hold circuits simultaneously through a single output channel, and an ADC 12C connected to the sampling part (SH) 12*b*. The data driver IC (SDIC) includes swapping parts 12*a*2 embedded in the sensing block (SB) 12*a*.

In normal operation, the DAC of the data driver IC (SDIC) converts digital video data RGB to a data voltage for image display and supplies it to the data lines 14A, in response to a data timing control signal DDC applied from the timing controller 11. In sensing operation, the DAC of the data driver IC (SDIC) generates a data voltage for sensing and supplies it to the data lines 14A, in response to a data timing control signal DDC applied from the timing controller 11.

The sensing block (SB) 12*a* of the data driver IC (SDIC) includes a current amplifier that receives current from the pixels through the sensing lines of the pixels connected to a first input terminal and receives a reference voltage through a reference voltage line connected to a second input terminal, and swaps the path for the current applied through the first input terminal and the path for the reference voltage applied through the second input terminal. The ADC 12C of the data driver IC (SDIC) sequentially and digitally processes the output voltages from the sensing block 12*a* and feeds them to the timing controller 11. The sampling part 12*b* includes a first sample & hold circuit SH1 disposed between the sensing block (SB) 12*a* and the ADC 12C to sample a first output voltage of the current integrator (CI) 12*a*1 and a second sample & hold circuit SH2 disposed between the sensing block (SB) 12*a* and the ADC 12C to sample a second output voltage of the current integrator (CI) 12*a*1, subsequent to the first output voltage. The sampling part 12*b* outputs the voltages sampled by the first and second sample & hold circuits SH1 and SH2 simultaneously through a single output channel.

The data driver IC (SDIC) includes an amplifier AMP. The swapping part 12*a*2 disposed within the amplifier AMP includes swap switches S1 and S2 for compensating for variations in offset voltage between the current integrators (CI) 12*a*1. The sampling part 12*b* includes a first sample & hold circuitSH1 and a second sample & hold circuitSH2. The sample & hold circuits comprise sample switches Q11 to Q1n, average capacitors C1 to Cn, and hold switches Q21 to Q2n, respectively.

The swapping part 12*a*2 includes a plurality of swap switches S1 and S2. The swap switches S1 and S2 comprise first swap switches S1 that are switched on to allow the current integrator (CI) 12*a*1 to output a first output voltage including a first offset voltage and second swap switches S2 that are switched on to allow the current integrator (CI) 12*a*1 to output a second output voltage including a second offset voltage with the opposite polarity of the first offset voltage.

The sampling part 12*b* includes sample switches Q11 to Q1n that perform control such that the first and second output voltages from the current integrator (CI) 12*a*1 are sequentially stored in average capacitors C1 to Cn, the average capacitors that sequentially store the first and second output voltages, and hold switches Q21 to Q2n that perform control such that the first and second output voltages stored in the average capacitors C1 to Cn are output simultaneously through a single output channel.

In normal operation, the gate driver circuit 13 generates a gate pulse for image display based on a gate control signal GDC, and then sequentially supplies it to the gate lines 15 in a line-sequential manner L#1, L#2, etc. In sensing operation, the gate driver circuit 13 generates a gate pulse for sensing based on a gate control signal GDC, and then sequentially supplies it to the gate lines 15 in a line-sequential manner L#1, L#2, etc. The gate pulse for sensing may have a wider on-pulse period than the gate pulse for image display. The on-pulse period of the gate pulse for sensing corresponds to per-line sensing ON time. Here, the per-line sensing ON time is the amount of scan time spent on simultaneously sensing 1 line of pixels L#1, L#2, etc.

The timing controller 11 generates a data control signal DDC for controlling the operation timing of the data driver circuit 12 and a gate control signal GDC for controlling the operation timing of the gate driver circuit 13, based on timing signals such as a vertical synchronization signal Vsync, a horizontal synchronization signal Hsync, a dot clock signal DCLK, a data enable signal DE, etc. The timing controller 11 detects normal operation and sensing operation based on a predetermined reference signal (driving power enable signal, vertical synchronization signal, data enable signal, etc.), and generates a data control signal DDC and a gate control signal GDC according to the operation type. Moreover, the timing controller 11 may generate additional control signals (signals for controlling the swapping part 12*a*2, including RST, SAM, HOLD, etc.) required for sensing operation.

In sensing operation, the timing controller 11 may feed to the data driver circuit 12 digital data that matches a data voltage for sensing. The timing controller 11 applies a digital sensed value SD fed from the data driver circuit 12 to a stored compensation algorithm, derives a threshold voltage variation ΔVth and a mobility variation ΔK, and then stores compensation data for variation compensation in a memory.

In normal operation, the timing controller 11 modulates digital video data RGB for image display based on the compensation data stored in the memory, and then feeds it to the data driver circuit 12.

Figure 7A:
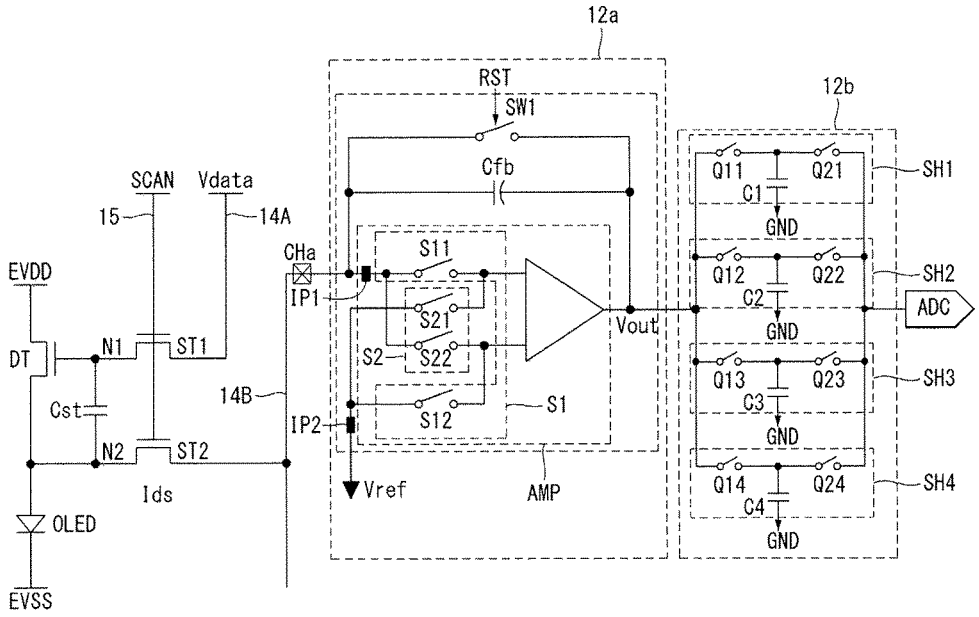
FIG. 7A shows the configuration of a pixel to which a current sensing method is applied and a detailed configuration of a current integrator and a sampling part that are sequentially connected to the pixel according to an embodiment of the present invention.
Figure 8:
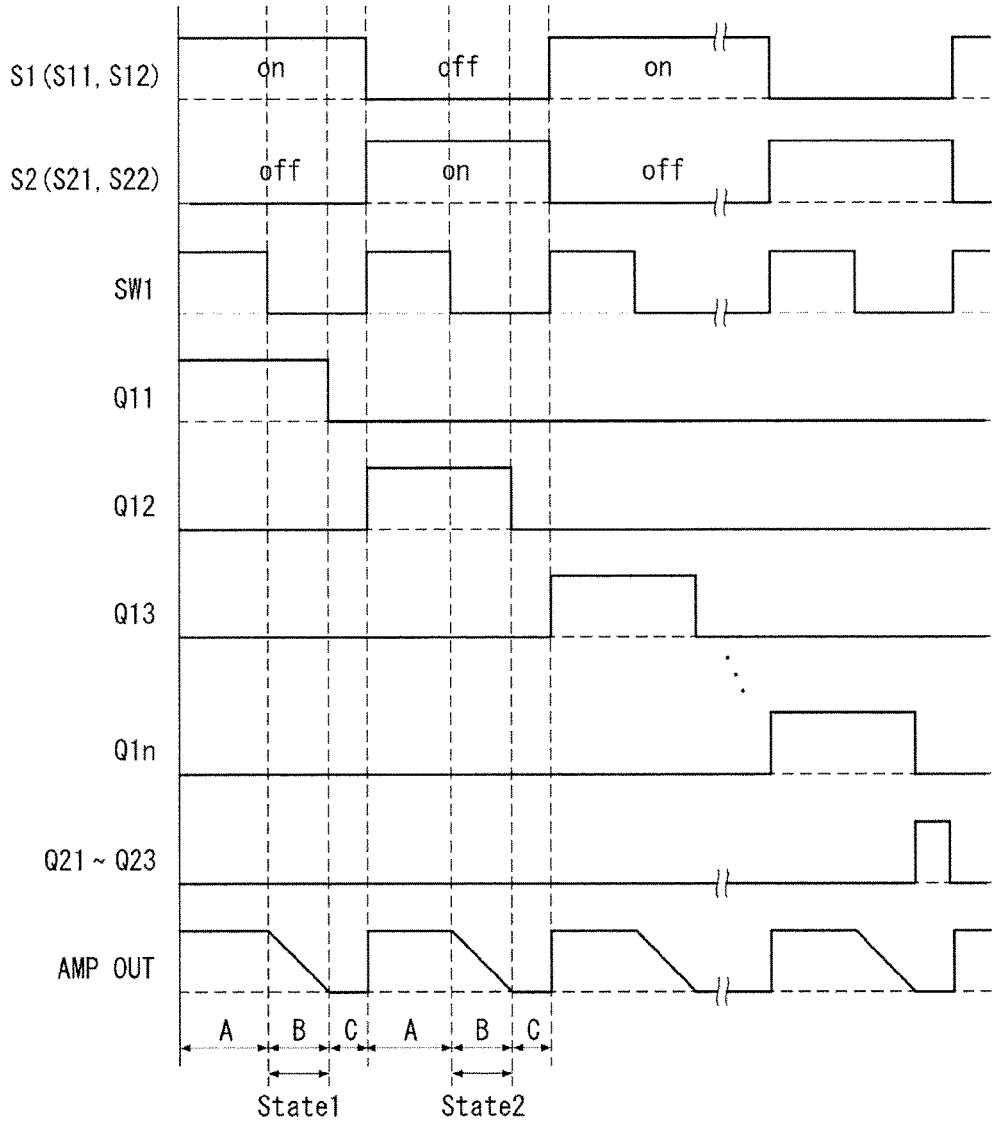
FIG. 8 shows the waveforms of driving signals applied to FIG. 7A for current sensing and the output voltages resulting from current sensing according to an embodiment.
Figure 9:
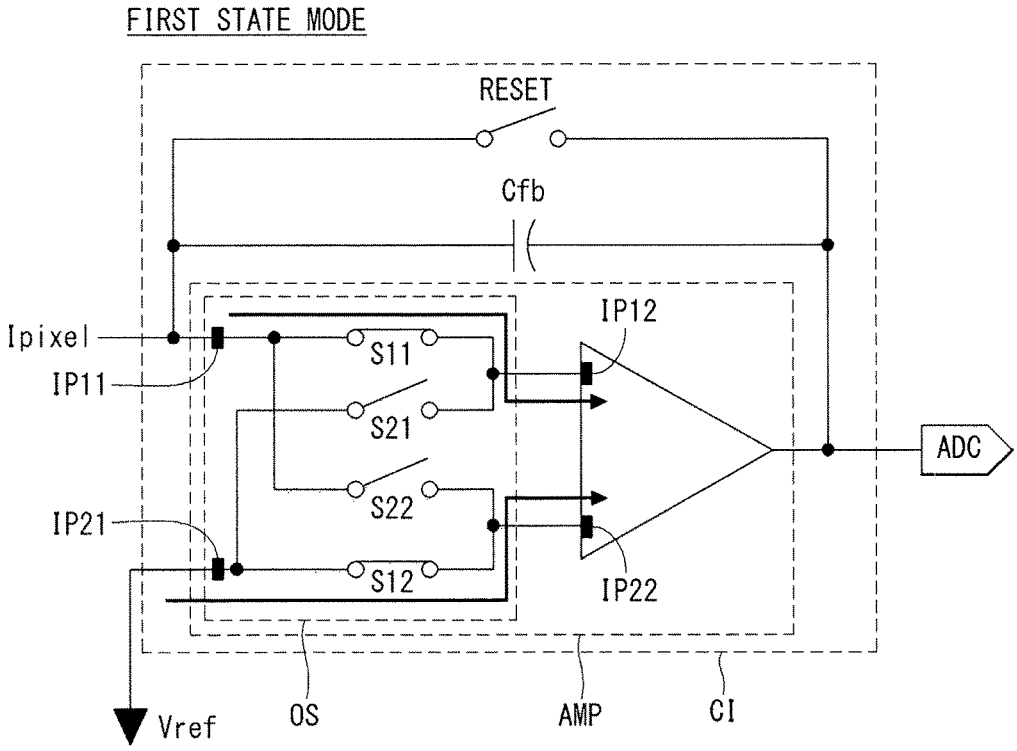
FIG. 9 shows a swapping part operating in a first state mode and the resultant output voltage according to an embodiment.
Figure 9:
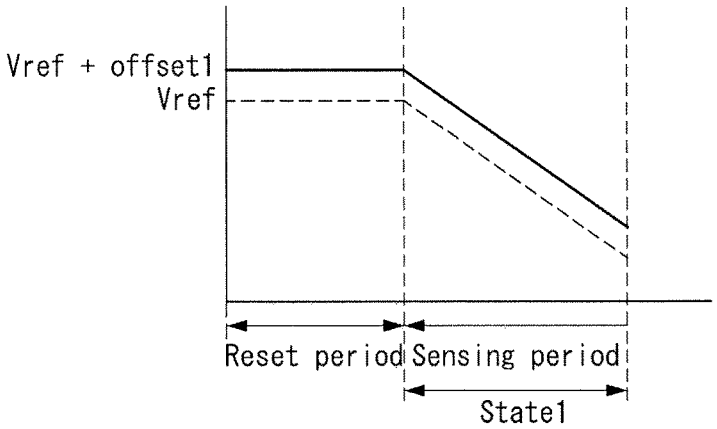
Figure 10:
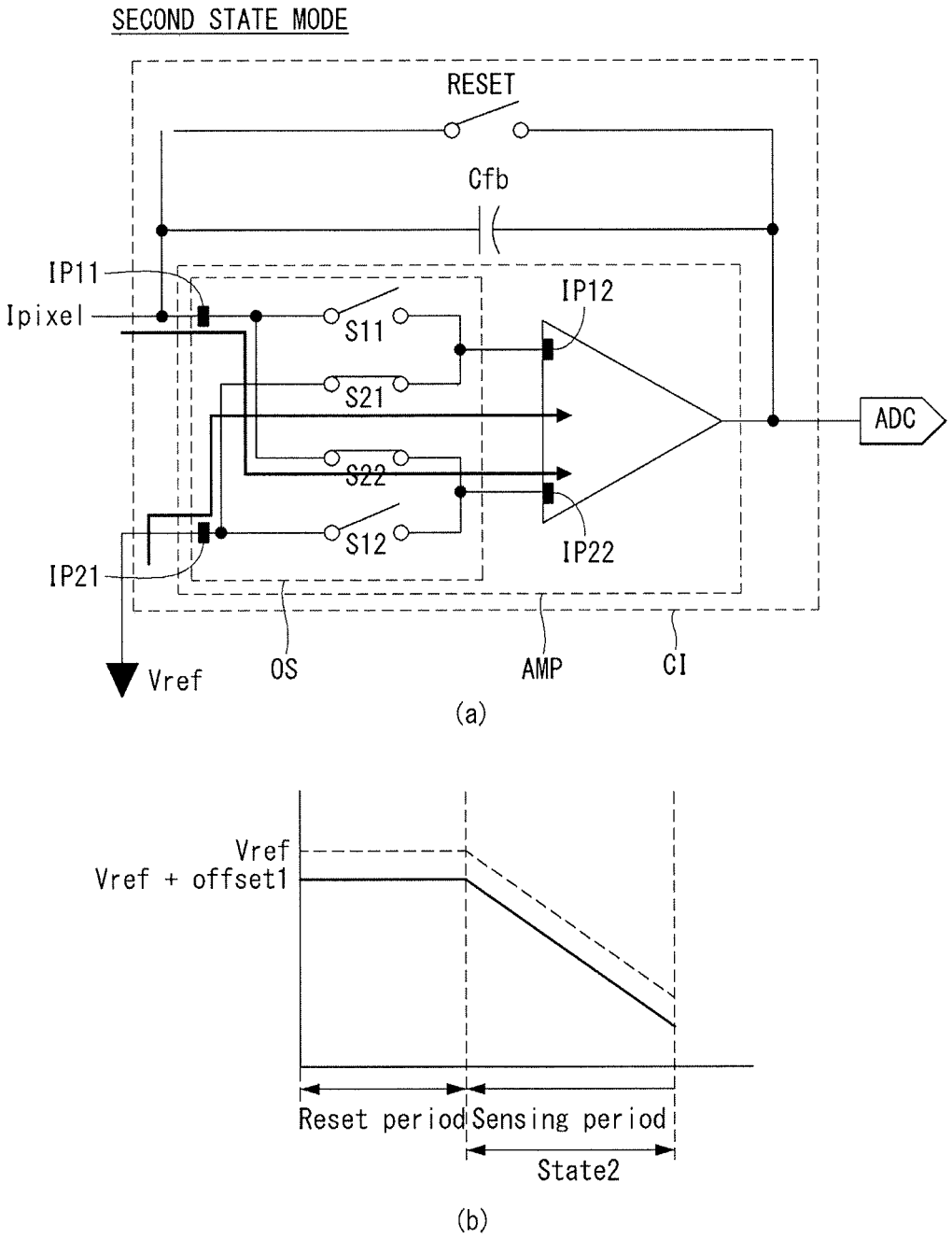
FIG. 10 shows a swapping part operating in a second state mode and the resultant output voltage according to an embodiment.

FIG. 7A shows the configuration of a pixel to which a current sensing method of the present invention is applied and a detailed configuration of a current integrator and a sampling part that are sequentially connected to the pixel. FIG. 8 shows the waveforms of driving signals applied to FIG. 7A for current sensing and the output voltages resulting from current sensing. FIG. 9 shows a swapping part operating in a first state mode. FIG. 10 shows a swapping part operating in a second state mode.

FIGS. 7A to 10 are merely an example given to help understanding of how current sensing works. The pixel structure to which the current sensing method of this invention is applied and its operation timing may be modified in various ways, so the technical spirit of the present invention is not limited to this embodiment.

Figure 7B:
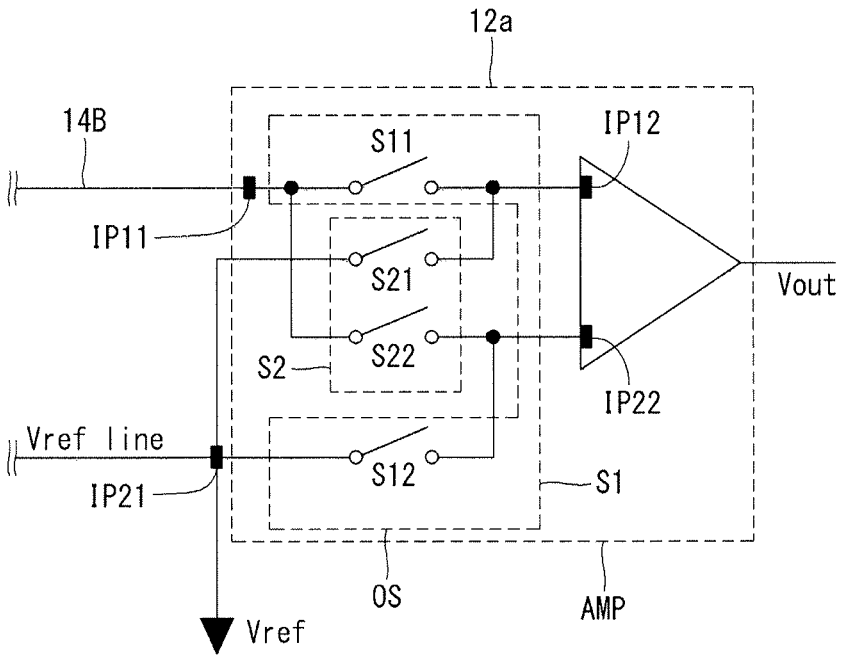
FIG. 7B is a view showing a detailed configuration of an amplifier according to an embodiment of the present invention.

Referring to FIGS. 7A and 7B, a pixel PIX of this invention may comprise an OLED, a driving TFT (thin film transistor) DT, a storage capacitor Cst, a first switching TFT ST1, and a second switching TFT ST2.

The OLED includes an anode connected to a second node N2, a cathode connected to an input terminal of a low-level driving voltage EVSS, and an organic compound layer positioned between the anode and the cathode. The driving TFT DT controls the amount of current input into the OLED in response to a gate-source voltage Vgs. The driving TFT DT includes a gate electrode connected to a first node N1, a drain electrode connected to an input terminal of a high-level driving voltage EVDD, and a source electrode connected to the second node N2. The storage capacitor Cst is connected between the first node N1 and the second node N2. The first switching TFT ST1 applies a data voltage Vdata on a data voltage supply line 14A to the first node N1 in response to a gate pulse SCAN. The first switching TFT ST1 includes a gate electrode connected to a gate line 15, a drain electrode connected to the data voltage supply line 14A, and a source electrode connected to the first node N1. The second switching TFT ST2 switches on the current flow between the second node N2 and a sensing line 14B in response to the gate pulse SCAN. The second switching TFT ST2 includes a gate electrode connected to the gate line 15B, a drain electrode connected to the sensing line 14B, and a source node connected to the second node N2.

The amplifier AMP of this invention includes a swapping part 12*a*2. The amplifier AMP includes a first input terminal IP1, a second input terminal IP2, and an output terminal that outputs a first output voltage or a second output voltage. The first input terminal IP1 comprises a first external input terminal IP11 connected to the sensing line 14B and a first internal input terminal IP12 connected to the first external input terminal IP11. The second input terminal IP2 includes a second external input terminal connected to a reference voltage line Vref and a second internal input terminal IP22 connected to the second external input terminal IP21.

The swapping part 12*a*2 is disposed between the first external input terminal IP11 and the first internal input terminal IP12 and between the second external input terminal IP21 and the second internal input terminal IP22, and swaps the current path and the reference voltage path. The swapping part 12*a*2 includes first swap switches S1 that cause the current integrator (CI) 12*a*1 to output a first output voltage including a first offset voltage and second swap switches S2 that cause the current integrator (CI) 12*a*1 to output a second output voltage including a second offset voltage. The first swap switches S1 comprise: an eleventh swap switch S11 with one end electrically connected to the first external input terminal IP11, and the other end electrically connected to the first internal input terminal IP21; and a twelfth swap switch S12 with one end electrically connected to the second external input terminal IP21, and the other end electrically connected to the second internal input terminal IP22. The second swap switches S2 comprise: a twenty-first swap switch S21 with one end electrically connected commonly to the second external input terminal IP21 and one end of the twelfth swap switch S12, and the other end electrically connected to the other end of the eleventh swap switch S11 and the first internal input terminal IP12; and a twenty-second swap switch S22 with one end electrically connected commonly to the first external input terminal IP11 and one end of the eleventh swap switch S11, and the other end electrically connected to the other end of the twelfth swap switch S12 and the second internal input terminal IP22.

The current integrator (CI) 12*a*1 including the amplifier AMP includes an integrating capacitor Cfb connected between the first input terminal IP1 and output terminal of the amplifier AMP, and a reset switch SW1 connected to both ends of the integrating capacitor Cfb.

The sampling part (SH) 12*b* includes a first sample & hold circuit SH1 disposed between the sensing block (SB) 12*a* and the ADC 12C to sample a first output voltage of the current integrator (CI) 12*a*1, and a second sample & hold circuit SH2 disposed between the sensing block (SB) 12*a* and the ADC 12C to sample a second output voltage of the current integrator (CI) 12*a*1, subsequent to the first output voltage.

The sample & hold circuits comprise sample switches Q11 to Q1n, average capacitors C1 to Cn, and hold switches Q21 to Q2n, respectively.

The first to nth sample & hold circuits SH1 to SHn are disposed in parallel. The sample switches Q11 to Q1n comprise first to nth sample switches Q11 to Q1n (where "n"

is a natural number greater than or equal to 2), the average capacitors C1 to Cn comprise first to nth average capacitors Cn (where "n" is a natural number greater than or equal to 2), and the hold switches Q21 to Q2n comprise first to nth hold switches Q21 to Q2n (where "n" is a natural number greater than or equal to 2).

One end of the first sample switch Q11 is electrically connected to the output terminal of the current integrator CI, and the other end is electrically connected commonly to one end of the first average capacitor C1 and one end of the first hold switch Q21. The other end of the first average capacitor C1 is electrically connected to a ground voltage GND. The other end of the first hold switch Q21 is electrically connected to the ADC 12C. One end of the second sample switch Q12 is electrically connected commonly to the output terminal of the current integrator CI and one end of the first sample switch Q11, and the other end is electrically connected commonly to one end of the second average capacitor C2 and one end of the second hold switch Q22. The other end of the second average capacitor C2 is electrically connected to the ground voltage GND. The other end of the second hold switch Q22 is electrically connected commonly to the ADC 12C and the other end of the first hold switch Q21. One end of the third sample switch Q13 is electrically connected commonly to the output terminal of the current integrator CI, one end of the first sample switch Q11, and one end of the second sample switch Q12, and the other end is electrically connected commonly to one end of the third average capacitor C3 and one end of the third hold switch Q23. The other end of the third average capacitor C3 is electrically connected to the ground voltage GND. The other end of the third hold switch Q23 is electrically connected commonly to the ADC 12C, the other end of the first hold switch Q21, and the other end of the second hold switch Q22. One end of the fourth sample switch Q14 is electrically connected commonly to the output terminal of the current integrator CI, one end of the first sample switch Q11, one end of the second sample switch Q12, and one end of the third sample switch Q13, and the other end is electrically connected commonly to one end of the fourth average capacitor C4 and one end of the fourth hold switch Q24. The other end of the fourth average capacitor C4 is electrically connected to the ground voltage GND. The other end of the fourth hold switch Q24 is electrically connected to commonly to the ADC 12C, the other end of the first hold switch Q21, the other end of the second hold switch Q22, and the other end of the third hold switch Q23.

While the above shows that the first to fourth sample switches Q11 to Q14 are all connected to the output terminal of the current integrator CI, the present invention is not limited to this, and the first to fourth sample switches Q11 to Q14 may be connected to the output terminals of a plurality of current integrators CI, respectively. While the above shows that a plurality of hold switches are provided, the present invention is not limited to this, and one hold switch Q21 may be electrically connected commonly to the other ends of the first to fourth average capacitors C1 to C4.

Referring to FIG. 8, a sensing operation includes a sensing & sampling period B and a standby period C.

In a reset period A, the amplifier AMP operates as a gain buffer unit with a gain of 1 by the turn-on of the reset switch SW1. In the reset period A, the first and second input terminals IP1 and IP2 and output terminal of the amplifier AMP, the sensing line 14B, and the second node N2 are all reset to a reference voltage Vref.

In the reset period A, a data voltage for sensing Vdata-SEN is applied to the first node NI through the DAC of the data driver IC (SDIC). Thus, the driving TFT DT becomes stable as a source-drain current Ids corresponding to a potential difference {(Vdata-SEN)-Vref} between the first node N1 and the second node N2 flows through it. However, the amplifier AMP continues to operate as the gain buffer unit during the reset period A, so the voltage level of the output terminal is maintained at the reference voltage Vref.

In the sensing & sampling period B, the amplifier AMP operates as a current integrator (CI) 12*a*1 by turning off (e.g., opening) the reset switch SW1, and integrates the source-drain current Ids flowing through the driving TFT DT. The sensing & sampling period B may be divided into a first state mode and a second state mode. The first state mode is defined as a period in which the swap switches S1 and S2 are controlled to output a first output voltage including a first offset voltage during the sensing & sampling period B. The second state mode is defined as a period in which the swap switches S1 and S2 are controlled to output a second output voltage including a second offset voltage during the sensing & sampling period B.

Referring to FIG. 8 and (a) of FIG. 9, in the sensing & sampling period of the first state mode, as the sensing time passes, that is, more current is accumulated, the potential difference between both ends of the integrating capacitor Cfb increases due to the electrical current Ids flowing into the first external input terminal IP11 of the amplifier AMP through the eleventh swap switch S11. In the context of the characteristics of the amplifier AMP, it would be ideal that the first input terminal IP1 and the second input terminal IP2 are shorted to a virtual ground, leaving a potential difference of zero between them; however, a first offset voltage other than zero is generated. The first offset voltage is positive. As shown in (b) of FIG. 9, in the sensing & sampling period B, the potential at the first input terminal IP1 is maintained at a first output voltage, which is the sum of the reference voltage Vref and the first offset voltage, regardless of an increase in the potential difference across the integrating capacitor Cfb. Instead, the potential at the output terminal of the amplifier AMP decreases corresponding to the potential difference between both ends of the integrating capacitor Cfb.

Based on this principle, in the sensing & sampling period B, the electrical current Ids flowing through the sensing line 14B is generated as the first output voltage through the integrating capacitor Cfb. The first output voltage is an integral produced by adding the first offset voltage. The falling slope of the first output voltage Vout of the current integrator (CI) 12*a*1 increases as more current Ids flows through the sensing line 14B. Thus, the greater the amount of current Ids, the lower the value of the integral Vsen. In the sensing & sampling period B, the first sample switch Q11 turns on in synchronization with the first swap switches S1, and the first hold switch Q21 turns off. Accordingly, the first output voltage is stored in the first average capacitor C1 through the first sample switch Q11.

Referring to FIG. 8 and (a) of FIG. 10, in the sensing & sampling period of the second state mode, as the sensing time passes, that is, more current is accumulated, the potential difference between both ends of the integrating capacitor Cfb increases due to the electrical current Ids flowing into the second external input terminal IP21 of the amplifier AMP through the twenty-first swap switch S21. In the context of the characteristics of the amplifier AMP, it would be ideal that the first input terminal IPI and the second input terminal IP2 are shorted to a virtual ground, leaving a potential difference of zero between them; however, a second offset voltage other than zero is generated. The second offset voltage is negative. Referring to (b) of FIG. 10, in the sensing & sampling period B, the potential at the first input terminal IP1 is maintained at a second output voltage, which is the sum of the reference voltage Vref and the second offset voltage, regardless of an increase in the potential difference across the integrating capacitor Cfb. Instead, the potential at the output terminal of the amplifier AMP decreases corresponding to the potential difference between both ends of the integrating capacitor Cfb.

Based on this principle, in the sensing & sampling period B, the electrical current Ids flowing through the sensing line 14B is generated as the second output voltage through the integrating capacitor Cfb. The second output voltage is an integral produced by adding the second offset voltage. The falling slope of the second output voltage Vout of the current integrator (CI) 12*a*1 increases as more current Ids flows through the sensing line 14B. Thus, the greater the amount of current Ids, the lower the value of the integral Vsen. In the sensing & sampling period B, the second sample switch Q12 turns on in synchronization with the second swap switches S2, and the second hold switch Q22 turns off. Accordingly, the second output voltage is stored in the second average capacitor C2 through the second sample switch Q12.

In the sensing & sampling period B, one of the first to fourth samples switches Q11 to Q14 turns on in synchronization with the first swap switches S1 or the second swap switches S2. For example, when the first swap switches S1 turn on, an electrical current applied through the first input terminal IP1 of the amplifier AMP is supplied to a current path formed between the first external input terminal IP11 and the first internal input terminal IP12, and a reference voltage applied through the second input terminal IP2 is supplied to a reference voltage path formed between the second external input terminal IP21 and the second internal input terminal IP22. Accordingly, the current is supplied to the amplifier AMP through the first external input terminal IP11 and the first internal input terminal IP12, and the reference voltage is supplied to the amplifier AMP through the second external input terminal IP21 and the second internal input terminal IP22. The first output voltage (including the first offset voltage) is output through the integrating capacitor Cfb and the output terminal of the amplifier AMP, and the first output voltage is stored in the first average capacitor C1 through the first sample switch Q11 which turns on in synchronization with the first swap switches S1.

On the other hand, when the second swap switches S2 turn on, an electrical current applied through the first input terminal IP1 of the amplifier AMP is supplied to a current path formed between the first external input terminal IP11 and the second internal input terminal IP22, and a reference voltage applied through the second input terminal IP2 is supplied to a reference voltage path formed between the second external input terminal IP21 and the first internal input terminal IP21. Accordingly, the current is supplied to the amplifier AMP through the first external input terminal IP11 and the second internal input terminal IP22, and the reference voltage is supplied to the amplifier AMP through the second external input terminal IP21 and the first internal input terminal IP12. The second output voltage (including the second offset voltage) is output through the integrating capacitor Cfb and the output terminal of the amplifier AMP, and the second output voltage is stored in the second average capacitor C2 through the second sample switch Q12 which turns on in synchronization with the second swap switches S2.

In this way, when the first swap switches S1 and the second swap switches S2 are sequentially operated in an alternating manner, the first output voltage and the second output voltage are sequentially output and sequentially stored in the third average capacitor C3 and the fourth average capacitor C4. In other words, the first and second swap switches (S1, S2) allow the inputs to be swapped for the amplifier AMP in the current integrator (CI), from receiving the current from sensing line 14B to receiving the reference voltage, or vice versa.

While the above description shows that the first to fourth sample switches Q11 to Q14 turn on sequentially, the present invention is not limited to this. The first to fourth sample switches Q11 to Q14 may turn on in random order. While the first to fourth sample switches Q11 to Q14 are operating, the first to fourth hold switches Q21 to Q24 remain in the off state.

As described above, once the first output voltage (including the first offset voltage) or the second output voltage (including the second offset voltage) is stored in the first to fourth average capacitors C1 to C4, the first to fourth sample switches Q11 to Q14 all turn on under the control of the timing controller 11, and the first to fourth hold switches Q21 to Q24 turn on simultaneously.

Once the first to fourth hold switches Q21 to Q24 turn on simultaneously, the average capacitors C1 to Cn produce output simultaneously through a single output channel. As the average capacitors C1 to Cn produce output simultaneously through a single output channel, the first output voltages and second output voltages stored in the average capacitors C1 to Cn may be averaged to a constant voltage and distributed. Accordingly, the first output voltages or second output voltages stored in the average capacitors C1 to Cn may be sampled and output as the average output voltage. The sampled average output voltage is input into the ADC through the hold switches Q21 to Q2n and a single output channel.

The sampled average output voltage is converted to a digital sensed value SD in the ADC and then fed to the timing controller 11. The digital sensed value SD is used for the timing controller 11 to derive a threshold voltage variation ΔVth and mobility variation ΔK between the driving TFTs. The timing controller 11 pre-stores the capacitance of the integrating capacitor Cfb, the reference voltage Vref, and the sensed value Tsen in digital code. Accordingly, the timing controller 11 may calculate the source-drain current Ids=Cfb*ΔV/Δt (where ΔV=Vref−Vsen and Δt=Tsen) flowing through the driving TFT DT based on the digital sensed value SD, which is a digital code for the sampled output voltage. The timing controller 11 applies the source-drain current Ids flowing through the driving TFT DT to a compensation algorithm to derive variations (a threshold voltage variation ΔVth and a mobility variation ΔK). The compensation algorithm may be implemented as a look-up table or a logic calculation.

The ADC 12C digitally processes the sampled average output voltage from the sampling part 12*b*, generates digital sensed values for compensation of variations in offset voltage, and feeds them to the timing controller 11. The timing controller 11 may calculate variations in offset voltage between the current integrators (CI) 12*a*1 based on the digital sensed values for compensation of variations in offset voltage, and compensate for these calculated variations.

The standby time C is a period of time from the end of the sensing & sampling period B until the start of the reset period A.

Moreover, the capacitance of the integrating capacitor Cfb included in the current integrator (CI) 12*a*1 of this invention is hundreds of times lower than the capacitance of the parasitic capacitor existing in the sensing line. Hence, the current sensing method of this invention can significantly reduce the time it takes to receive electrical current Ids until it reaches an integral Vsen that enables sensing, compared to the conventional voltage sensing method.

Further, in the conventional voltage sensing method, when sensing a threshold voltage, the source voltage of the driving TFT is sampled as a sensed voltage after it reaches saturation, which leads to long sensing time; whereas, in the current sensing method of this invention, when sensing threshold voltage and mobility, the source-drain current of the driving TFT can be integrated within a short time by means of current sensing and the integral can be sampled, which leads to a significant reduction in sensing time.

In addition, the present invention allows for obtaining sensed values that are more accurate, since a constant sampled output voltage is produced by compensating for variations in offset voltage between the current integrators CI by means of the swapping parts 12*a*2 and sampling parts 12*b* embedded in the amplifiers AMP.

As above, the current sensing method of this invention offers the advantage over the conventional voltage sensing method in that it allows for low-current sensing and fast sensing. With this advantage, the current sensing method of this invention makes it possible to perform sensing for each pixel multiple times within per-line sensing ON time, in order to enhance sensing performance.

While the foregoing description has been given of an example in which analog filtering is used to compensate for variations in offset voltage between the current integrators CI and output a constant sampled output voltage, the present invention is not limited to this example and digital filtering also may be used.

Figure 11:
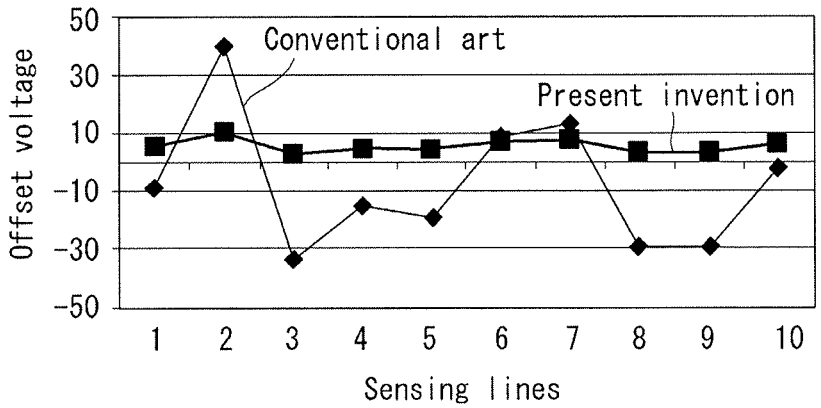
FIG. 11 is a view showing offset voltages that are output from current integrators according to an embodiment of the present invention.
Figure 12:
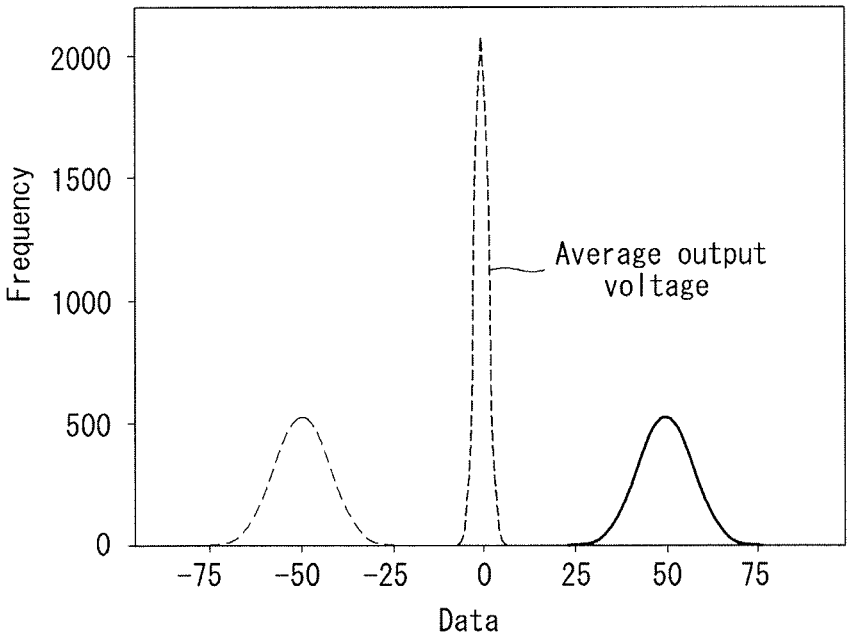
FIG. 12 is a view showing the averaging of the output voltages including the offset voltages output from the current integrators according to an embodiment of the present invention.

In digital filtering (digital average filter), the sum of digital sensed values output form the ADC can be divided out by n, thereby calculating the average of the digital sensed values. The average of the digital sensed values output through the digital filter is fed to the timing controller 11. The timing controller 11 may calculate variations in offset voltage between the current integrators (CI) 12*a*1 based on the digital sensed values for compensation of variations in offset voltage, and compensate for these calculated variations. FIG. 11 shows offset voltages that are output respectively from a plurality of current integrators (CI) 12*a*1 according to the present invention. FIG. 12 shows the dispersion of output voltages including the offset voltages output from the plurality of current integrators (CI) 12*a*1 according to the present invention.

Referring to FIGS. 11 and 12, the output voltages (including offset voltages) output through the conventional current integrators (CI) 12*a*1 range from a maximum output voltage of 40 mV to a minimum output voltage of −40 mV, which leaves a difference of 80 mV between the maximum output voltage and the minimum output voltage. Since the output voltages from the conventional current integrators (CI) 12*a*1 have different offset voltages, the output voltage from the output terminal may vary even if substantially the same amount of current input into the input terminals of the conventional current integrators (CI) 12*a*1. That is, the output voltage has a large degree of dispersion due to the differences in offset voltage between the amplifiers AMP, resulting in a large error margin.

On the other hand, in the present invention, a constant sampled output voltage is produced by compensating for variations in offset voltage between the current integrators CI by means of the swapping parts 12*a*2 and sampling parts 12*b* embedded in the amplifiers AMP, and the sampled output voltage ranges from a maximum output voltage of 10 mV to a minimum output voltage of −10 mV, which leaves a difference of 20 mV between the maximum output voltage and the minimum output voltage.

Accordingly, the output voltage has a small degree of dispersion due to the compensation of the differences in offset voltage between the amplifiers AMP, which results in a small error margin. Therefore, a constant sampled output voltage is produced by compensating for variations in offset voltage between the current integrators CI by means of the swapping parts 12*a*2 and sampling parts 12*b* embedded in the amplifiers AMP. As a consequence, the present invention allows for more accurate sensed values to be obtained, compared to the conventional art, and enables panel compensation using the more accurate sensed values, thereby improving the reliability of sensing and compensation.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light-emitting display comprising:

a display panel including sensing lines connected to pixels;

a current integrator configured to:

receive current from a pixel among the pixels through a sensing line among the sensing lines connected to a first input terminal, receive a reference voltage through a reference voltage line connected to a second input terminal, swap a path through which the current applied through the first input terminal flows and a path through which the reference voltage applied through the second input terminal is supplied, and output a first output voltage including a first offset voltage and a second output voltage including a second offset voltage corresponding to swap paths;

a sampling part including a first sample and hold circuit for sampling the first output voltage of the current integrator and a second sample and hold circuit for sampling a second output voltage of the current integrator that swapped a path through which the current applied through the first input terminal flows and the reference voltage applied through the second input terminal is supplied subsequent to the first output voltage, wherein the sampling part outputs the first and second output voltages sampled by the first and second sample and hold circuits simultaneously through a single output channel of the sampling part; and an analog-to-digital converter configured to convert the voltages received from the single output channel to digital sensed values and output the digital sensed values.

2. The organic light-emitting display of claim 1, wherein the current integrator comprises:

an amplifier including a first amplifier input terminal, a second amplifier input terminal, and an output terminal for outputting the first output voltage or the second output voltage;

an integrating capacitor connected between the first amplifier input terminal and output terminal of the amplifier; and a reset switch connected to both ends of the integrating capacitor.

3. The organic light-emitting display of claim 2, wherein the first amplifier input terminal comprises: a first external input terminal connected to the sensing line; and a first internal input terminal connected to the first external input terminal, and wherein the second amplifier input terminal comprises: a second external input terminal connected to the reference voltage line; and a second internal input terminal connected to the second external input terminal, and wherein a swapping part is disposed between the first external input terminal and the first internal input terminal and between the second external input terminal and the second internal input terminal, and configured to swap the path through which the current flows and the path through which the reference voltage is supplied.

4. The organic light-emitting display of claim 3, wherein the swapping part comprises:

first swap switches that are switched on to output a first output voltage including the first offset voltage; and second swap switches that are switched on to output a second output voltage including the second offset voltage with the opposite polarity of the first offset voltage.

5. The organic light-emitting display of claim 3, wherein the first swap switches comprise:

an eleventh swap switch connected to the first external input terminal and the first internal input terminal; and a twelfth swap switch connected to the second external input terminal and the second internal input terminal, wherein the second swap switches comprise: a twenty-first swap switch connected to the second external input terminal and the first internal input terminal; and a twenty-second swap switch connected to the first external input terminal and the second internal input terminal, and wherein one end of the eleventh swap switch and one end of the twenty-second swap switch are commonly connected, and one end of the twelfth swap switch and one end of the twenty-first swap switch are commonly connected.

6. The organic light-emitting display of claim 5, wherein the first sample and hold circuit comprises:

a first average capacitor for storing the first output voltage output from the current integrator;

a first sample switch connected between the current integrator and the first average capacitor for controlling the first output voltage to be stored in the first average capacitor; and a first hold switch connected between the first average capacitor and the analog-to-digital converter for outputting the first output voltage stored in the first average capacitor through the single output channel, and wherein the second sample and hold circuit comprises:

a second average capacitor for storing the second output voltage output from the current integrator;

a second sample switch connected between the current integrator and the second average capacitor for controlling the second output voltage to be stored in the second average capacitor; and a second hold switch connected between the second average capacitor and the analog-to-digital converter for outputting the second output voltage stored in the second average capacitor through the single output channel.

7. The organic light-emitting display of claim 6, wherein the first sample switch stores the first output voltage output from the current integrator in the first average capacitor, in synchronization with the first swap switches, and wherein the second sample switch stores the second output voltage output from the current integrator in the second average capacitor, in synchronization with the second swap switches.

8. The organic light-emitting display of claim 6, wherein the first hold switch and the second hold switch turn on simultaneously and output the first output voltage and the second output voltage simultaneously through the single output channel.

* * * * *